US007311229B1

(12) United States Patent
Wrigley

(10) Patent No.: US 7,311,229 B1
(45) Date of Patent: Dec. 25, 2007

(54) SLIDE TAP

(75) Inventor: Andrew N. Wrigley, Auckland (NZ)

(73) Assignee: Illinois Tool Works Inc, Glenview, IL (US)

( * ) Notice: Subject to any disclaimer, the term of this patent is extended or adjusted under 35 U.S.C. 154(b) by 662 days.

(21) Appl. No.: 10/831,528

(22) Filed: Apr. 23, 2004

Related U.S. Application Data

(60) Provisional application No. 60/488,690, filed on Jul. 18, 2003.

(51) Int. Cl.
*B67D 3/00* (2006.01)
*B65D 47/00* (2006.01)

(52) U.S. Cl. ..... 222/518; 222/524; 222/549; 222/559

(58) Field of Classification Search ..... 222/518, 222/522–524, 559, 547, 549, 567, 541.5
See application file for complete search history.

(56) References Cited

U.S. PATENT DOCUMENTS 2,508,939 A * 5/1950 De Swart ..... 222/196
3,355,143 A * 11/1967 Mueller ..... 251/321
4,619,377 A 10/1986 Roos ..... 222/83
4,700,744 A 10/1987 Rutter et al.
4,742,851 A * 5/1988 Lundblade ..... 137/614.12
5,445,298 A * 8/1995 Strong ..... 222/153.14
5,680,970 A 10/1997 Smith et al. ..... 222/514
6,296,157 B1 10/2001 Erb
6,360,925 B2 3/2002 Erb
2001/0052530 A1 12/2001 Friedman ..... 222/518

FOREIGN PATENT DOCUMENTS

| | | |
|---|---|---|
| BE | 484124 | 7/1948 |
| CH | 356681 | 8/1961 |
| CH | 390142 | 3/1965 |
| EP | 0432070 | 12/1994 |
| GB | 216 9061 | 2/1984 |
| WO | WO 95/22504 | 8/1995 |

* cited by examiner

*Primary Examiner*—Kevin Shaver
*Assistant Examiner*—Melvin Cartagena
(74) *Attorney, Agent, or Firm*—Mark W. Croll; Paul F. Donovan

(57) ABSTRACT

A slide tap particularly suitable for use on disposable containers has a valve body with a sliding actuator movable between closed and opened positions of an outlet formed in the body. A spring mechanism returns the actuator to a closed position.

21 Claims, 6 Drawing Sheets

SLIDE TAP

CROSS-REFERENCE TO RELATED APPLICATIONS

The present application claims the benefits of U.S. Provisional Application No. 60/488,690 filed on Jul. 18, 2003.

FIELD OF THE INVENTION

The present invention generally relates to container valves, and, more specifically, the valve of the present invention may be used in so-called "bag-in-a-box" fluid dispensing applications where it is of advantage to have a self-closing valve or tap assembly, which can be operated easily, and quickly and is inexpensive to manufacture and install.

BACKGROUND OF THE INVENTION

A variety of valves and taps have been developed and used to dispense a wide range of fluids from various containers. One common application for disposable taps and valves is "bag-in-a-box" products in which a bladder is provided within a cardboard box or other semi-rigid container, and a low cost, disposable tap is provided to dispense fluid from the bladder. Such structures have been used to dispense water and other beverages such as wine or juice, chemicals and other liquids.

In bag-in-a-box assemblies, the valve component desirably is formed inexpensively, from low cost materials, since the entire packaging assembly, including the valve, is intended to be discarded once the content of the bladder has been dispensed. Of course, the valve must still operate effectively, to tightly close and prevent spills or leakage even after long periods of use with frequent or infrequent opening and closing cycles.

One problem associated with such tap or valve assemblies is the ease with which they can be operated to dispense fluid from the disposable bladder. Some of the known designs require the use of several fingers of one or both hands to operate an actuation button or lever efficiently. Some designs require the user's hands to be placed in an awkward position. Furthermore, some of these assemblies require a separate movement from the user to close the tap or valve in addition to the first movement to open the valve. This, too, can be awkward, requiring repositioning of the user's hand and increasing the risk of accidental spilling or overflowing the container being filled from the dispenser. It is also possible that the user may not completely close the valve, resulting in intermittent dripping of fluid from the valve.

Some known valves provide relatively turbulent output flow, and external spouts are required to control the stream and prevent splashing. External spouts are undesirable in that the valve is necessarily positioned at the bottom of the container, and a spout of any significant length may project past the bottom of the container. For the container to sit flat, a long spout must be positioned at the front edge of a shelf, table or other support to hand beyond it.

What is needed is a valve or tap assembly that can be operated easily, closes automatically and securely, yet can be provided at reasonable expense.

SUMMARY OF THE INVENTION

The present invention provides a slide tap operated by a squeezing action with one hand, and includes a spring mechanism to return the tap automatically to a securely closed position upon release of the squeezing action.

In one aspect thereof, the present invention provides a tap with a substantially cylindrical body having an outer end portion with an end cap and a side opening. An outlet port in the body dispenses fluid from the tap. A cylindrical actuator has a closed outer end slidable along the side opening in the body. An open inner end of the actuator is configured to slide across the outlet port, selectively exposing and covering the outlet port. An annular seat in the body receives the actuator open end in fluid tight engagement. A spring mechanism is operable between the body and the actuator for biasing the actuator in a direction for covering the outlet port and engaging the actuator open end against the seat.

In another aspect thereof, the present invention provides a slide tap with a body defining a channel including a first open end and an outlet port from which fluid is dispensed. An actuator has a cylindrical shape with a closed end thereof configured to slide back and forth within the channel. An open end of the actuator slide across the outlet port, selectively exposing and covering the outlet port. A seal on one of the actuator and the body engages a seat on the other of the actuator and the body. A spring mechanism operates between the body and the actuator for biasing the actuator in a direction for closing the slide tap by covering the outlet port.

In still another aspect thereof, the present invention provides a slide tap with a substantially cylindrical body having an inner end portion with first open end configured for receiving fluid to be dispensed from a container, an outer end portion having an end cap and a side opening, and a central portion between the inner and outer end portions. An outlet port for dispensing fluid is defined in the central portion. A cylindrical actuator has a closed end slidable with the body along the side opening of the outer end portion. An open end of the actuator slides across the outlet port, selectively exposing and covering the outlet port. A seal is formed between the actuator open end and the body when the tap is closed. A spring mechanism operates between the body and the actuator for biasing the actuator in a direction for closing the slide tap by covering the outlet port.

An advantage of the present invention is providing a fluid-dispensing slide tap that can be operated easily and comfortably, and that closes automatically when not operated for opening.

Another advantage of the present invention is providing a fluid-dispensing slide tap that can be manufactured using relatively low cost materials and manufacturing techniques for use on disposable packaging applications.

Still another advantage of the present invention is providing a fluid-dispensing slide tap that has tamper-evident structures providing a visible indicator when the seal has been breached.

Yet another advantage of the present invention is providing a fluid dispensing slide tap that can be secured in an open position, to dispense large volumes of fluid from the container without the need to hold the slide tap in an open position.

Other features and advantages of the invention will become apparent to those skilled in the art upon review of the following detailed description, claims and drawings in which like numerals are used to designate like features.

Figure 1:
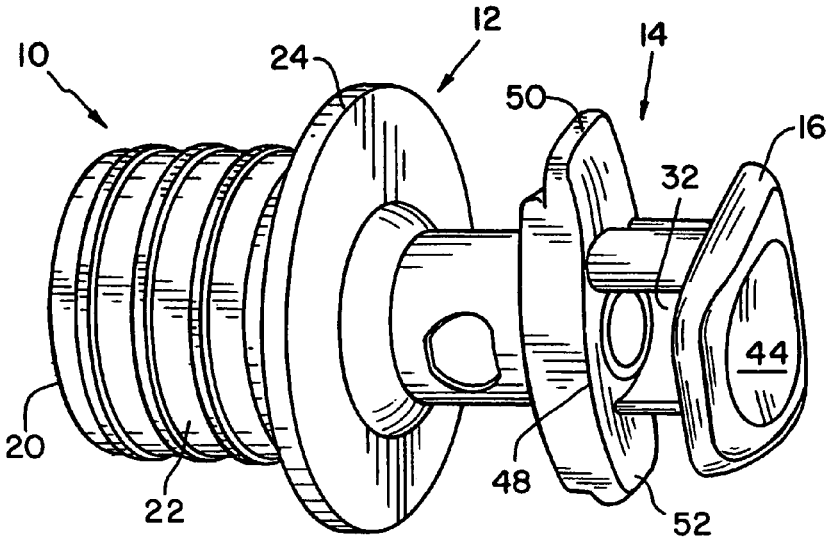
FIG. 1 is a perspective view of a slide tap slide tap in accordance with the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including" and "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings, FIG. 1 is a perspective view of a slide tap assembly 10 in accordance with the present invention. Slide tap assembly 10 can be used for dispensing liquids from a variety of packages or containers, including but not limited to bag-in-a-box type packages. While references herein will be made to a bag-in-a-box type of application, those skilled in the art will understand and appreciate that other applications for the invention are also considered. For example, in one embodiment one end of the slide tap assembly may be provided with a male or female-thread connection system to allow it to be engaged with other components of a fluid delivery or dispensing apparatus.

Figure 2:
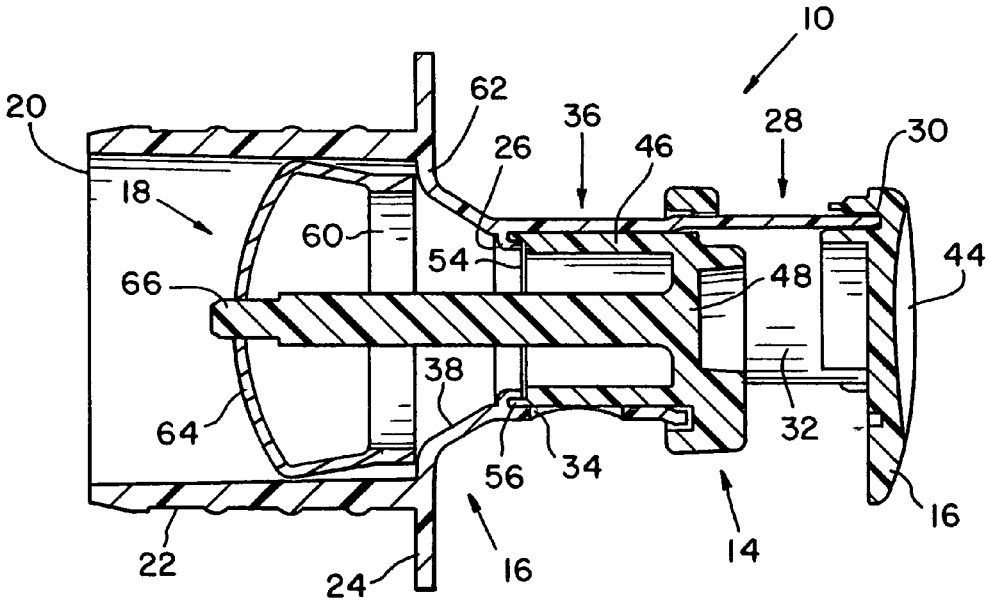
FIG. 2 is a cross sectional view of the slide tap shown in FIG. 1, illustrating the tap in a closed position.

Slide tap assembly 10 includes a valve body 12, an actuator 14 slidably disposed within valve body 12, an end cap 16 disposed at the outer end of valve body 12, and a spring mechanism 18 (FIG. 2) operable between valve body 12 and actuator 14 to bias actuator 14 toward a closed position for slide tap assembly 10.

Valve body 12 is substantially cylindrical, having an open inner end 20 disposed within the fluid containing structure (not shown) for which slide tap assembly 10 is provided. An inner end portion 22 of body 12 adjacent inner end 20 is suitably configured for attachment to the package or container (not shown) in which slide tap assembly 10 is used. Inner end portion 22 may be ribbed as shown, threaded or otherwise configured for attachment, and may include a lateral flange 24 for positioning adjacent an outer surface (not shown) of the package or container (not shown).

An internal surface of valve body 12 defines a valve seat 26 for engaging actuator 14 in a substantially fluid tight relationship. In the embodiment shown in FIG. 2, valve seat 26 is a groove disposed in an annular flange on body 12. An outer end portion 28 of valve body 12, adjacent an outer end 30 of valve body 12, defines a side opening in said body, forming an open channel 32. Inwardly from open channel 32, an outlet port 34 is disposed in a substantially closed central portion 36 of body 12, between inner end portion 22 and outer end portion 28. As shown in the exemplary embodiments of the drawings, outer end portion 28 and central portion 36 are of smaller diameter than inner end portion 22, with a short conical section 38 of body 12 interconnecting inner end portion 22 with central portion 36.

End cap 16 is affixed to outer end 30, such as by snap-fit, adhesive, material welding or the like, and includes a depression 44 for receiving a thumb tip or finger of a user of slide tap assembly 10. Depression 44 is shaped to enhance comfort and efficiency for an individual actuating slide tap assembly 10. A thumb or other fingertip of the user can be placed in depression 44 to reduce the likelihood that the thumb or finger will slide from end cap 16 as slide cap assembly 10 is actuated.

Actuator 14 defines a generally cylindrical sleeve 46 having an outer closed end 48 and laterally protruding wings 50 and 52 (FIG. 1) therefrom. Outer closed end 30 slides substantially within channel 32, with wings 50 and 52 projecting outwardly of outer end portion 28 in valve body 12. Wings 50 and 52 define a handle by which actuator 14 can be moved within body 14. An open inner end 54 of actuator 14 defines an annular seal 56 to engage against valve seat 26 to form a fluid-tight closure of slide tap assembly 10. As illustrated, valve seat 26 is a generally circular channel, and seal 58 defines an annular ring that can slide into channel seat 26. Other sealing arrangements also can be used.

During use of slide tap assembly 10, open inner end 54 slides across outlet port 34 in valve body 12 to regulate and control the size of the opening through outlet port 34, and consequently the flow rate therethrough. Actuator 14 functions substantially as a knife valve to form a clean, non-drip shut off when slide tap assembly 10 is closed.

Spring mechanism 18 includes a base 60 which may be a ring or other structure to anchor spring mechanism 18 against valve body 12, such as against a ledge 62 in body 12. A spring leaf 64 supported by base 60 is connected to outer closed end 48 of actuator 14 via an arm 66. Arm 66 can be integral with actuator 14 and connected to spring leaf 64 or can be a separate piece connected to each. Alternatively, spring mechanism 18 can be formed with an integral arm 66 connectable to actuator 14. Required connections can be made by snap-fit of the components, material welding, adhesive or the like.

Figure 3:
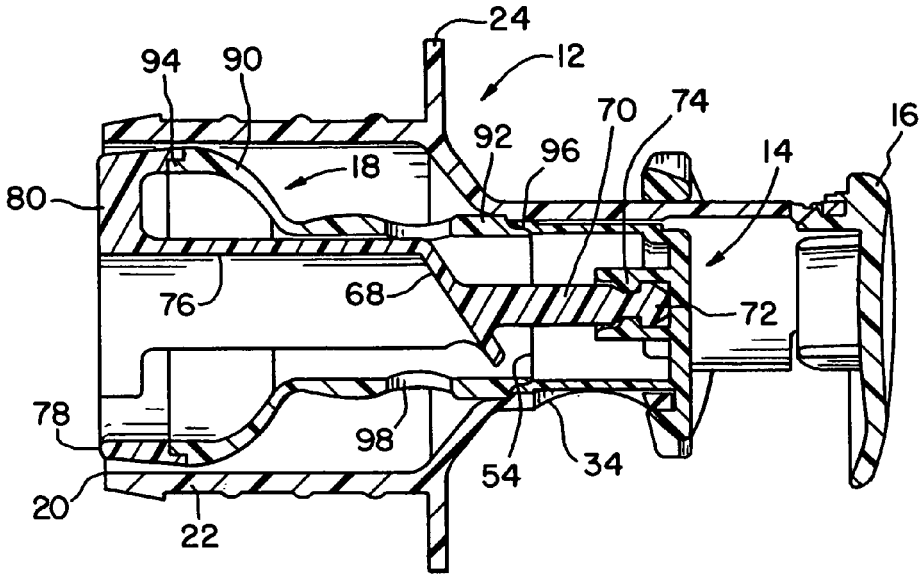
FIG. 3 is a cross sectional view similar to FIG. 2, but illustrating a modified form of the slide tap in a closed position.
Figure 4:
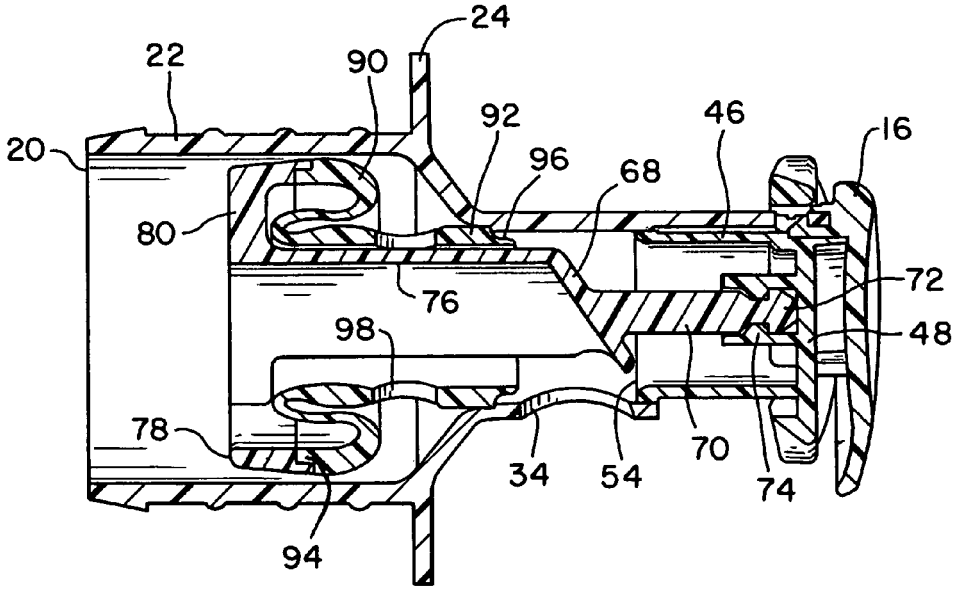
FIG. 4 is a cross sectional view of the embodiment shown in FIG. 3, but illustrating the slide tap in an opened position.
Figure 5:
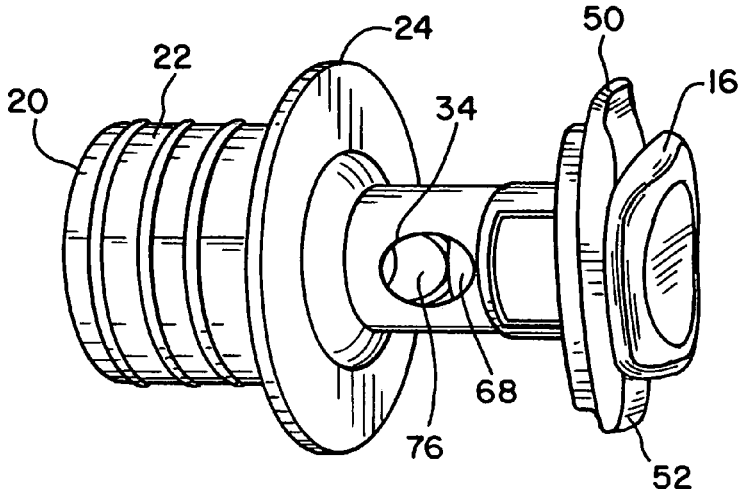
FIG. 5 is a perspective view of a slide tap of the present invention depicted with the slide tap in an opened position.

FIGS. 3 and 4 illustrate a second embodiment of the present invention, which includes a flow directing surface on a plate 68 for directing fluid flow toward outlet port 34. Plate 68 is on a shortened arm 70 connected to actuator 14, and is disposed at an angle preferable between about 45 degrees and 60 degrees to the axis of valve body 12. Plate 68 provides a more laminar flow of fluid through outlet port 34, without the need for an external spout, and is positioned substantially at the outer edge out outlet port 34 when actuator 14 is in a fully-open position (FIG. 5).

FIGS. 3 and 4 further illustrate another structure for interconnecting actuator 14 with spring mechanism 18. Shortened arm 70 has a shaped outer end 72 that is received in a snap-fit connector 74 on outer closed end 48 of actuator 14. From plate 68, a part cylindrically-shaped member 76 extends into inner end portion 22 of slide tap 10, and is connected to a substantially annular head 76 by one or more braces 80. Head 78 is connected to spring mechanism 18.

FIGS. 3 and 4 also illustrate a modified spring mechanism 18 in the form of an elastomeric sleeve 90. Elastomeric sleeve 90 has a first end 92 connected to valve body 12 in a permanent, fluid tight connection around the entire circumference, and a second end 94 connected to head 78. First end 92 forms a valve seat 96 in the form of an annular channel between the outermost end of sleeve 90 and body 12, the base of which is closed by the fluid tight connection to body 12. Seat 96 is configured for receiving inner end 54 of sleeve 46, which may be tapered. According to one feature of the present invention, internal pressures created within the tap assembly 10 assist in maintaining the seal created between the valve seat 96 and end 54 of sleeve 46 when the valve is closed. If internal pressures exceed the spring force of the spring mechanism 18, the valve may be caused to open. However, the relationship between the valve seat 96 and the end 54 of the sleeve 46 is such that small movement of the sleeve 46 will not cause the seal to be completely or undesirably broken. The arrangement functions somewhat like a pressure-relief valve.

Elastomeric sleeve 90 is a resiliently deformable shaped member having shape memory. Thus, sleeve 90 can be folded as shown in FIG. 4 when slide tap assembly 10 is opened, and provides closing force sufficient to close slide tap assembly 10 when actuator 14 is released and elastomeric sleeve 90 returns to its original shape. One or more holes 98 in sleeve 90 allow flow therethrough between regions of change shape as sleeve 90 first deforms and then returns to its original shape. Although not shown, according to another embodiment of the present invention, at least one additional hole is provided in the large end 94 of the deformable sleeve 90. This at least one hole reduces the initial spring force to cause the opening of the valve, thereby providing better control over the opening of the valve, especially if one desires to gradually open the valve.

Figure 6:
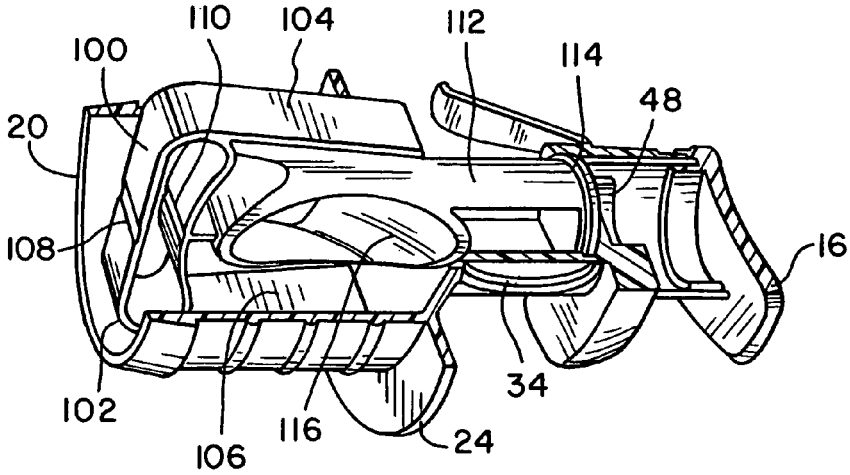
FIG. 6 is a cutaway view of another embodiment of a slide tap of the present invention.
Figure 7:
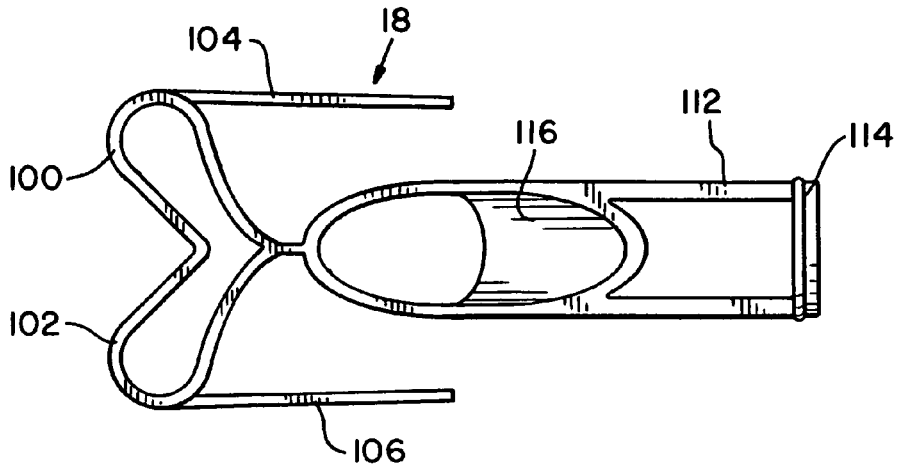
FIG. 7 is a plan view of the spring mechanism in the slide tap of FIG. 6, shown in the deflect position caused upon opening the slide tap.
Figure 8:
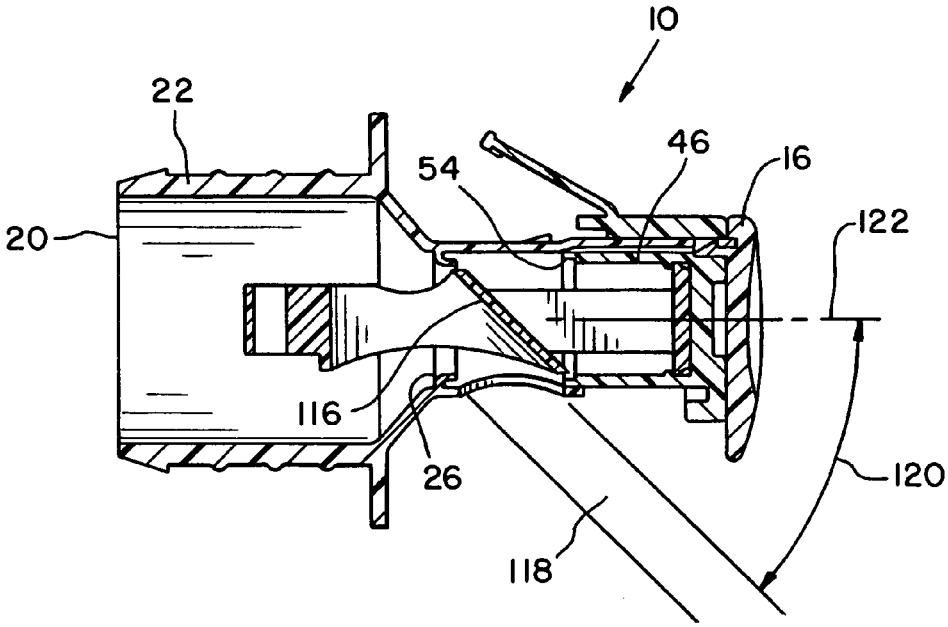
FIG. 8 is a cutaway view showing the liquid dispensing pattern from a slide tap of the present invention.

FIGS. 6 and 7 illustrate yet another modification of the present invention in which an alternate spring mechanism 18 is connected to end 48 of actuator 14. Two bow-shaped members 100, 102 are connected to anchor members 104, 106 that are substantially fixed in position relative to body 12. Bow shaped members 100, 102 can be deflected to a substantially heart shaped configuration as shown in FIG. 7 when the valve is open, with bending occurring at thinned material areas 108 and 110. Upon release of the opening force, bow shaped members 100, 102 return to the non-defined position shown in FIG. 6. Various plastics can be used thinned and/or thickened in specific areas of the structure, as necessary to provide the desired deflection and spring-like return for actuator 14. Shaped in such a manner, the initial spring tension provides a high initial force to resist internal container pressure of perhaps 10 psi. After the spring mechanism has been moved a few millimeters, the required actuation force decreases, to make opening easier. However, force is still sufficient to return actuator 14 to the closed position when opening force is released. An arm 112 is connected to bow-shaped members 100, 102 and includes a base 114 connected to end 48, and a curved flow-directing plate 116 that functions similarly to plate 68 described previously. As shown in FIG. 8, plates 68 and 116 direct a flow stream 118 from outlet part 34 away from the container (not shown) on which slide tap assembly 10 is used. An angle designated by arrowed line 120 in FIG. 8 of between about 45 degrees and 60 degrees from the valve body axis 122 has been found to be advantageous.

Figure 9:
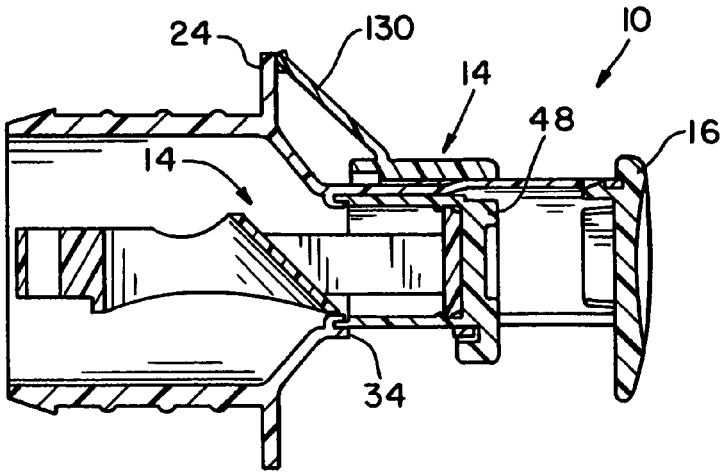
FIG. 9 is a cutaway view illustrating a tamper proof feature of the invention.
Figure 10:
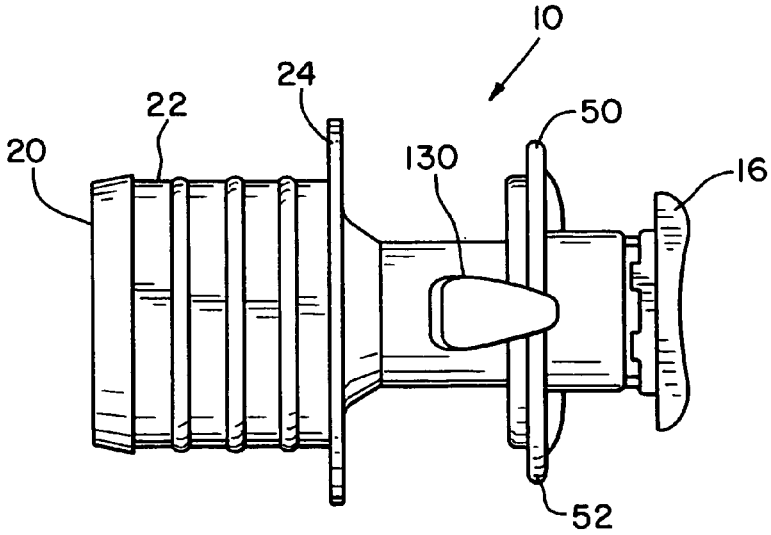
FIG. 10 is a plan view of the top of a slide tap of the present invention.

The present slide tap assembly also can be provided in a tamper-resistant configuration. FIGS. 8-9 illustrate a bar 130 flexibly or detachably connected to actuator 14 and which can be welded or otherwise adhered to flange 24. Movement of actuator 14 from a fully closed position toward an open position requires that a connection be broken between bar 130 and flange 24 or between bar 130 and actuator 14. Thus, bar 130 inhibits accidental opening of slide tab assembly 10 and provides a visual indication that the tap has been opened. Variations are possible, such as bar 130 being connected to central portion 36 of body 12, rather than to flange 24.

Figure 11:
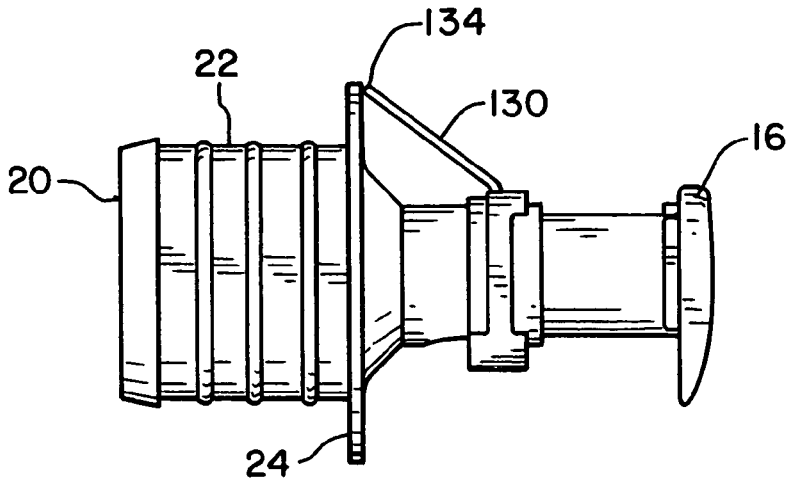
FIG. 11 is a side view of a slide tap of the present invention shown in the closed position.
Figure 12:
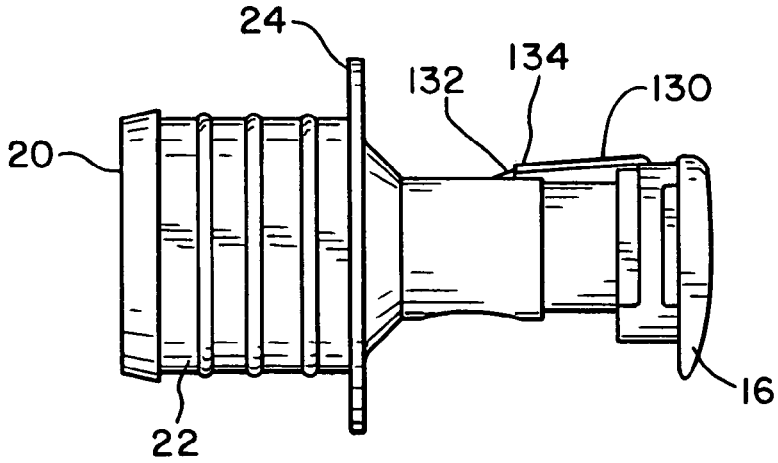
FIG. 12 is a side view of the slide tap of FIG. 12, but illustrating the slide tap in an open position, secured for continuous fluid dispensing.

In some uses of the present invention it may be desirable to retain slide tap assembly 10 in a fully opened position, such as for filling large containers such as, for example, pitchers or the like. While slide tap assembly 10 can merely be held in the opened position utilizing two fingers and the thumb of one hand, this to can be inconvenient if a large volume of fluid is to be dispensed. FIGS. 11 and 12 illustrate the manner in which slide tap assembly 10 can be secured in an open position. A knob 132 is provided on the outer surface of valve body 12 in alignment with bar 130. When actuator 14 is moved to a fully opened position, bar 130 can be pressed so that a distal end 134 thereof aligns with knob 132. While holding bar 130 in this position, actuator 14 is released such that spring mechanism 18 moves actuator 14 slightly towards the closed position. Bar 130 is thereby wedged against knob 132, and spring mechanism 18 provides sufficient force to hold bar 130 against knob 132 and thereby hold actuator 14 in the open position. To close slide tap assembly 10, actuator 14 is again moved slightly towards the more fully open position, and bar 130 is allowed to spring upwardly or is moved upwardly away from knob 132. When actuator 14 is again released, spring mechanism 18 will move actuator 14 into the fully closed position.

The present invention provides an easily actuated slide tap assembly that can be opened with one hand and provides a fluid-tight closure. The slide tap assembly is self-closing upon release of the actuator. Flow directing structures provide improved flow characteristics. The component parts of the slide tap assembly can be manufactured of plastic by simple molding techniques, and can be assembled with map-fitting connections or other simple assembly processes. The slide tap assembly therefore is suitable for use with disposable containers, such as bag-in-a-box products.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A slide tap comprising:

a body defining a channel including a first open end and an outlet port from which fluid is dispensed;

an actuator slidable within said channel, said actuator being a cylindrical shape with a closed end thereof configured to slide back and forth within said channel, and an open end of said actuator configured to slide across said outlet port, selectively exposing and covering said outlet port;

a handle connected to said actuator for applying force to said actuator to open the tap by sliding said actuator in said body channel;

a seal on one of said actuator and said body for engaging a seat on the other of said actuator and said body; and a spring mechanism operable between said body and said actuator for biasing said actuator in a direction for closing said slide tap by covering said outlet port, said spring mechanism configured to provide greater resistance as said actuator is moved from a closed position and lessened resistance as said actuator approaches a fully opened position.

2. The slide tap of claim 1, said handle formed integrally with said actuator.

3. The slide tap of claim 1, said spring mechanism being an elastomeric sleeve.

4. The slide tap of claim 1, said spring mechanism being a resilient deformable material.

5. The slide tap of claim 1, said handle including opposed, laterally extending wings projecting outwardly of said body.

6. The slide tap of claim 1, said body including an end cap having a depression therein.

7. The slide tap of claim 1, said spring mechanism having a leaf spring anchored in said body, and said actuator being connected to said leaf spring.

8. The slide tap of claim 1, said spring mechanism having a bow shaped member deformed when said outlet port is exposed.

9. The slide tap of claim 1, said actuator including an angled surface to direct flow through said slide tap toward said outlet port.

10. The slide tap of claim 1, said body defining an annular seat, and said actuator have a cylindrical end for engaging said seat.

11. A slide tap comprising:

a body defining a channel including a first open end and an outlet port from which fluid is dispensed;

an actuator slidable within said channel, said actuator having a cylindrical shape with a closed end thereof configured to slide back and forth within said channel, and an open end of said actuator configured to slide across said outlet port, selectively exposing and covering said outlet port;

a handle connected to said actuator for applying force to said actuator to open the tap by sliding said actuator in said body channel;

a seal on one of said actuator and said body for engaging a seat on the other of said actuator and said body;

a spring mechanism operable between said body and said actuator for biasing said actuator in a direction for closing said slide tap by covering said outlet port;

a frangible link connected between said actuator and said body; and wherein said actuator including a bar, and said body having a knob for engaging said bar to hold said actuator in a position exposing at least a part of said outlet port.

12. The slide tap of claim 11, said bar being connected to said body by said frangible link.

13. A slide tap comprising:

a substantially cylindrical body having an inner end portion with first open end configured for receiving fluid to be dispensed from a container, an outer end portion having an end cap and a side opening, and a central portion between said inner and outer end portion;

an outlet port for dispensing fluid, said outlet port defined in said central portion;

a cylindrical actuator having a closed end slidable within said body along said side opening of said outer end portion, and an open end of said actuator configured to slide across said outlet port, selectively exposing and covering said outlet port;

a seal formed between said actuator open end and said body when said tap is closed; and a spring mechanism operable between said body and said actuator for biasing said actuator in a direction for closing said slide tap by covering said outlet port, said spring mechanism configured to provide greater resistance as said actuator is moved from a closed position and lessened resistance as said actuator approaches a fully opened position.

14. The slide tap of claim 13, said seal including an annular channel for receiving said actuator open end.

15. The slide tap of claim 13, said spring mechanism being an elastomeric sleeve.

16. The slide tap of claim 15, said seal including a closed channel formed between said sleeve and said body, said channel configured to receive said actuator open end.

17. The slide tap of claim 13, said spring mechanism being a resilient deformable material.

18. The slide tap of claim 13, said spring mechanism having a leaf spring anchored in said body, and said actuator being connected to said leaf spring.

19. The slide tap of claim 13, said spring mechanism having a bow shaped member deformed when said outlet port is exposed.

20. The slide tap of claim 13, including a flow-directing plate disposed at an angle to the valve axis, for guiding fluid to said outlet.

21. The slide tap of claim 20, said angle being between about 45 degrees and about 60 degrees.

* * * * *